United States Patent [19]

Blake

[11] Patent Number: 4,887,743

[45] Date of Patent: Dec. 19, 1989

[54] AEROSOL VALVE

[76] Inventor: William S. Blake, 14 Georgetown Ct., Linwood, N.J. 08221

[21] Appl. No.: 60,171

[22] Filed: Jun. 10, 1987

[51] Int. Cl.[4] ..... B65D 83/00

[52] U.S. Cl. ..... 222/402.1; 222/402.24

[58] Field of Search ..... 222/402.1, 402.13, 402.2, 222/402.21, 402.23, 402.24, 402.25, 394; 251/353, 354, 347, 348

[56] References Cited

U.S. PATENT DOCUMENTS

| | | | |
|---|---|---|---|
| 2,835,418 | 5/1958 | Manetti | 222/402.13 X |
| 2,883,090 | 4/1959 | Remane | 222/402.24 |
| 3,158,326 | 11/1964 | Remane | 222/402.24 X |
| 3,343,730 | 9/1967 | Nier et al. | 251/353 X |
| 3,415,426 | 12/1968 | Kleveland | 251/354 X |
| 3,598,324 | 8/1971 | Cooper | 251/353 X |
| 4,762,254 | 8/1988 | Nitta | 222/402.24 |

FOREIGN PATENT DOCUMENTS

| | | | |
|---|---|---|---|
| 2802061 | 8/1978 | Fed. Rep. of Germany | 222/402.22 |

*Primary Examiner*—Michael S. Huppert
*Attorney, Agent, or Firm*—Dennis H. Lambert

[57] ABSTRACT

An aerosol valve (10) adapted to be secured to the neck of a container (C) may be manufactured from synthetic plastic material and includes a main body (11), a flexible valve housing and seat member (26) secured and sealed to the main body, and a poppet valve (35) freely reciprocable in the space defined between the main body and flexible housing. The flexible housing (26) has a valve seat (33) and the poppet valve (35) has a valve head (36) arranged to seat on the valve seat. The main body has a poppet retainer (24, 25) and the poppet valve has a tail piece (37) with a detent (38) thereon in a position to cooperate with the retainer on the main body to limit movement of the poppet valve. The flexible housing includes a diaphragm (29) with a preset bias tending to close the valve head on the valve seat, and an actuator (46) may be manipulated to overcome the bias and unseat the valve head from the seat to enable flow of product from the container. In another form (60) of the invention, plural seating surfaces (73, 74 and 33, 36) are provided on the poppet valve (61) and flexible valve housing (62). In a further form (109) of the invention, a second valve head (110) is on the poppet opposite the first valve head (36) for cooperation with a second valve seat (40) to obtain metered dispensing.

28 Claims, 6 Drawing Sheets

AEROSOL VALVE

DESCRIPTION

1. Field of the Invention:

This invention relates generally to aerosol dispensers, and more particularly, to an improved valve for aerosol dispensers.

2. Background Art:

Conventional aerosol valves usually employ a diaphragm seal gasket to effect a static seal when the valve is not being actuated and a sliding or flexing seal during valve actuation. In structures incorporating axial stem travel, the diaphragm seal gasket should be clamped so that it does not move with the stem, and the stem to mounting cup clearance must be minimized to prevent excessive radial interference between the step and diaphragm seal gasket. Further, the diameter of the center opening in the diaphragm seal gasket must be carefully designed to maintain a sliding seal with the stem and move across the stem orifice outer opening. Most such conventional structures utilize a side port opening on the stem land where the diaphragm seal gasket and stem land interface seal occurs, requiring careful molding techniques and selection of materials to reduce the liklihood of swelling. Tolerances must also be carefully maintained to insure accuracy in valve performance.

Conventional aerosols also typically incorporate springs to return the diaphragm and/or stem to a seated position, and must rely upon gaskets to effect a seal between the valve components and the container. Moreover, on some current aerosol structures, a clean room environment is required for assembly and filling. The use of metal ferrules to secure the valve components to a metal can often results in displacement of metal shavings from the can, which may contaminate the product being dispensed. The use of aluminum ferrules can lead to oxidation of the metal, with consequent rouging and potential contamination of the product being dispensed. Other problems may also exist with conventional aerosol valve structures, such as crimping or dishing of the diaphragm seal gasket, leading to potential leakage or inoperativeness of the valve.

Efforts have been made in the art to eliminate or reduce some or all of the above problems. For instance, some valves have been made from plastic and designed so as to eliminate the use of separate springs, or metal ferrules, and the like. Other designs have eliminated the side port valving action, which is subject to being rendered inoperative because of misalignment of parts, swelling, etc.

Examples of several prior art designs are shown in the following U.S. Pat. Nos.: 2,774,665, 2,835,418, 3,123,261, 3,144,179, 3,372,844, 3,401,849, 3,580,431, 3,613,728, 3,669,316, 3,856,263, 3,862,741, 4,541,552, and 4,570,826. The valves disclosed in these patents variously utilize all-plastic construction, eliminate separate springs and side port valving, and/or use other means to avoid one or more of the problems enumerated above, or to solve other problems and achieve objects not specifically mentioned above. However, the valves disclosed in these patents either fail to provide superior performance and/or reliability, or are relatively expensive and difficult to produce, or still retain one or more of the problems mentioned earlier.

DISCLOSURE OF THE INVENTION

Accordingly, it is an object of this invention to provide an aerosol valve which is less expensive, has fewer parts, and is more simple to produce and assemble than prior art devices.

Another object of the invention is to provide an aerosol valve in which separate springs and side port sealing are eliminated.

A further object of the invention is to provide an aerosol valve in which the use of rubber is eliminated, and all components of the valve may be produced from synthetic plastic materials.

An even further object of the invention is to provide an aerosol valve comprised of plastic components which may be sonically welded together, including the use of PET for both the valve and container on which the valve is mounted.

Still another object of the invention is to provide an aerosol valve having a minimum number of parts, and which may be adapted for use on different style containers, such as glass, metal or plastic bottles or cans.

Yet another object of the invention is to provide an aerosol valve having an interchangeable stem so that stems of different size may be easily substituted for use with different actuators.

A still further object of the invention is to provide an aerosol valve construction which may be easily converted or modified for either continuous or metered dispensing.

These and other objects and advantages of the invention are accomplished by the improved valving structure of the invention.

In accordance with the invention, an aerosol valve is manufactured from plastic materials and includes a freely reciprocable poppet member mounted for movement in a chamber defined between a resilient valve housing and seat member and a main cylinder housing and poppet retainer. The housing and poppet retainer are adapted to be secured to a container by any suitable means. For instance, if the valve is to be secured to a plastic bottle, the cylinder housing may be sonically welded to the neck ring of the container. Similarly, the valve housing and seat member may be sonically welded to the cylinder housing, and a stem member may be sonically welded to the valve housing and seat member to complete the assembly. In another form of the invention, the components of the valve may be snapped together and the flexible valve housing may be sonically welded to the container. Other means may be used for securing the valve assembly to a container, as, for example, screw threads, metal ferrules, etc.

In one form of the invention, an interchangeable stem is provided so that stems of different size may be substituted on the valve housing and seat member.

The valve housing and seat member has a flexible diaphragm or bellows-like portion with a preset bias for urging the valve seat and poppet member into sealing engagement with one another, and the poppet and valve retainer have intergaging portions to retain the poppet to limited axial movement. Depression of the stem flexes the diaphragm and moves the poppet until it engages against the retainer. Continued movement of the stem and diaphragm unseats the valve seat and poppet, enabling flow from the container.

In one configuration of the invention, the flexible valve housing and seat member includes a depending cylindrical portion which slides in a complementally shaped portion of the cylinder housing and retainer. In that form of the invention which provides for continuous flow during dispensing, pressure in the container thus acts on that portion of the valve housing within the cylindrical portion or extension, assisting in urging the poppet and valve seat into sealing engagement with one another.

In another configuration of the invention, pressure in the container is exposed to the entire undersurface of the diaphragm, providing additional closing force.

In the continuous flow versions of the invention, the poppet has one or more slots or openings in the tail piece so that when the poppet has reached its limit of movement in the valve opening direction, flow of product from the container around the poppet is possible.

In the metered flow versions, the tail piece of the poppet has a valving member which closes the passage from the container to the valving chamber when the poppet has reached its limit of travel in the valve opening direction. Further, in this form of the invention, the dip tube may be eliminated if desired.

The valve construction thus described has a minimum number of parts, and may be produced from plastic materials, including recycled PET. At the same time, the valve exhibits superior performance, requiring less closing force than prior art constructions, and is less susceptible to variations in tolerance, assembly forces, etc., than are prior art devices.

BRIEF DESCRIPTION OF THE DRAWINGS:

The foregoing and other objects and advantages of the invention will become apparent from the following detailed description and accompanying drawings, in which like reference characters designate like parts throughout the several views, and wherein.

BEST MODE FOR CARRYING OUT THE INVENTION

Figure 2:
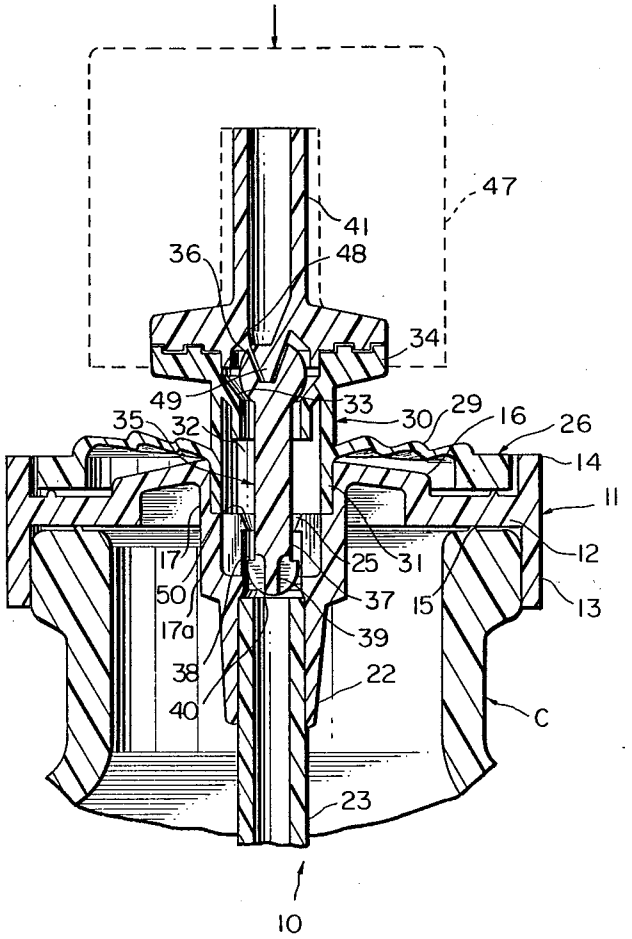
FIG. 2 is a vertical sectional view similar to FIG. 1, showing the valve in open position.

Referring more specifically to the drawings, a first form of the invention is shown generally at 10 in FIGS. 1 through 8, and comprises a main cylinder housing and poppet retainer 11 having a flat, annular end wall portion 12 with a depending cylindrical skirt 13 and upstanding cylindrical flange 14 on the outer marginal edge thereof. The underside of the annular wall portion 12 is adapted to be suitably secured to the end of the neck of a container C, as by sonic welding, for example. An energy bead 15 on the upper end of the neck of the container concentrates the energy during the sonic welding process. When thus assembled, the skirt 13 extends downwardly in close fitting relationship around the open upper end of the container. An inwardly and upwardly sloping, raised annular wall portion 16 is formed on the inner marginal edge of the flat annular portion 12, and terminates at its inner marginal edge in a depending, cylindrical retainer housing 17 having a reduced diameter lower end portion 17A with a pair of diametrically opposed, outwardly projecting enlargements 18 and 19. A pair of longitudinally extending slots 20 and 21 are formed on the inner surface of the lower end portion 17A at the locations of the enlargements 18 and 19. The slots terminate short of the bottom end of the lower end portion 17A, and a further diametrically reduced, dip tube housing extension 22 projects downwardly from the lower end of the retainer housing 17, 17A, for holding a dip tube 23. A pair of arcuate, inwardly projecting retaining flanges 24 and 25 are formed on the inner surface of the housing 17, at the juncture between the upper and lower portions thereof. As seen best in FIGS. 3 and 6, the retaining flanges are circumferentially offset 90° from the positions of the slots 20 and 21.

Figure 1:
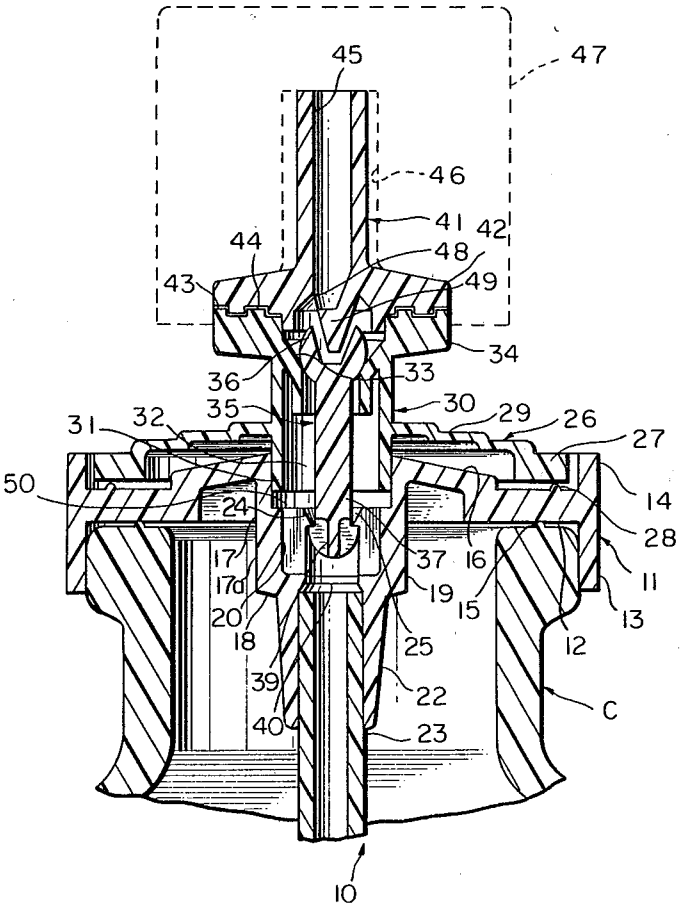
FIG. 1 is a vertical sectional view of a first form of valve according to the invention, showing a neck ring fragment of the container, with the valve in closed position.
Figure 4:
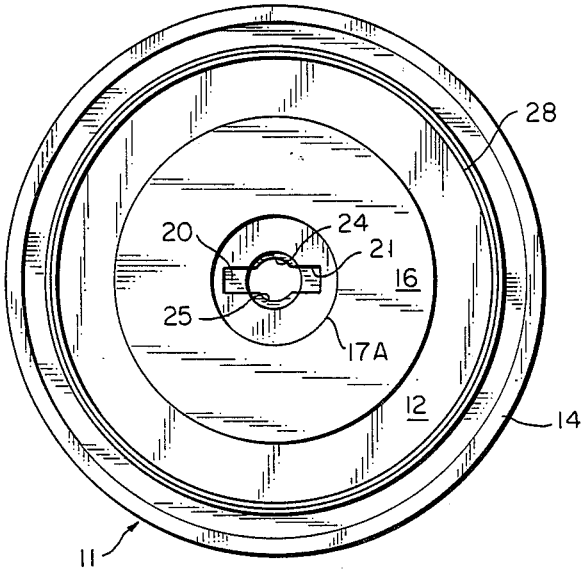
FIG. 4 is a top plan view of the retainer of FIG. 3.
Figure 3:
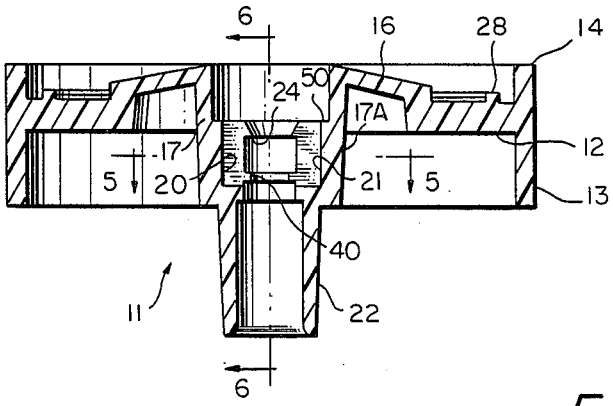
FIG. 3 is an enlarged, vertical sectional view of the cylinder housing and poppet retainer.
Figure 7:
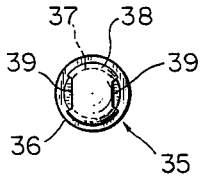
FIG. 7 is a bottom end view of the poppet of FIG. 1.
Figure 5:
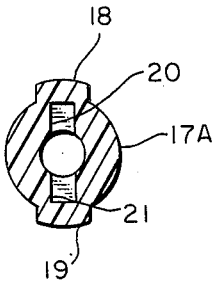
FIG. 5 is a transverse sectional view taken along line 5—5 in FIG. 3.
Figure 6:
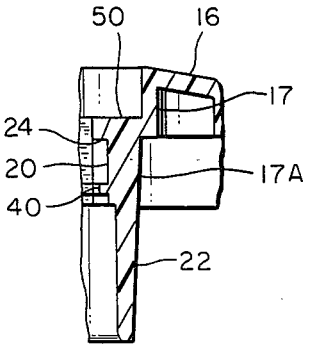
FIG. 6 is a fragmentary vertical sectional view taken along line 6—6 in FIG. 3.

A flexible valve housing and seat member 26 is sonically welded via an annular marginal flange 27 thereon to the top of the wall portion 12 of the retainer housing 11. Energy bead 28 on the top of the wall portion 12 concentrates energy during the sonic welding process. The upstanding flange 14 on the the retainer housing 11 projects upwardly in surrounding relationship to the outer marginal edge of the annular flange 27 on the valve housing and seat member 26, protecting the structure and providing a pleasing appearance. A flexible diaphragm or bellows-like structure 29 extends inwardly from the flange 27, and carries a cylindrical valve seat member 30 at its center. As seen in FIG. 1, the cylindrical valve seat member extends both upwardly and downwardly from the plane of the diaphragm 29, and the lower end 31 slides in the cylindrical retainer housing 17, defining with the retainer housing a valve chamber 32. The upper end of the valve seat member has a downwardly and inwardly sloping valve seat 33 formed therein, and a diametrically enlarged stem attaching flange 34 on its upper outer surface.

A poppet valve 35 is freely reciprocably positioned in the valve chamber 32, and includes an enlarged valve head 36 extending above the seat 33 and adapted to seal against the seat to preclude flow through the valve. The poppet valve also includes a tail piece 37 which extends downwardly through the valve chamber into the lower end 17A of the cylindrical retainer housing 17. An outwardly projecting ledge 38 with slotted flow channels 39 forms a detent or retainer on the lower end of the valve tail piece 37 for cooperation with the retaining flanges 24 and 25 in the retainer housing 17 to limit upward movement of the valve poppet 35 to the position shown in FIG. 1. Downward movement of the valve poppet is limited by engagement of the tail piece 37 against the lower end of the housing 17A, or against a seat/stop 40 just above the dip tube as shown in FIG. 2. The slots 39 in the tail piece enable flow past the tail piece when the valve is in an open position (positioned downwardly against the seat/stop 40, as shown in FIG. 2).

Figure 8:
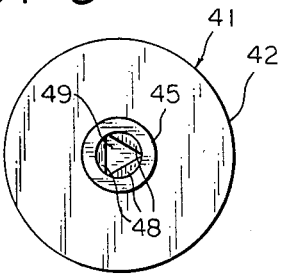
FIG. 8 is a top plan view of the stem of FIG. 1.

A stem 41 is sonically welded to the top of the stem attaching flange 34 on the upper end of the valve seat member 30, and has an annular flange 42 corresponding generally in size and shape to the flange 34. Energy beads 43 and 44 concentrate the energy during the sonic welding process. The stem has an elongate, upwardly extending, tubular outlet extension 45 which is adapted to extend into the passage 46 in an actuator 47 positioned over the stem. As seen in FIGS. 1, 2 and 8, the stem has a plurality of slots or passages 48 formed therein for enabling flow of product from the valve to the interior of the tubular outlet extension 45. Further, a downwardly projecting valve engaging member 49 is formed on a lower central portion of the stem for engaging the valve poppet 35 to move it downwardly in timed relationship with the flexible valve housing and seat member when the actuator 47 and stem 41 are moved downwardly to open the valve to begin a dispensing operation.

When the parts are in their normal, at-rest position shown in FIG. 1, the pressure of the contents of the container act on the poppet and on the valve seat member 30 to urge them upwardly to the position shown. Additionally, the diaphragm 29 has a preset bias urging the valve seat member 30 upwardly into tight engagement with the valve head 36 on the poppet, which is restrained against further upward movement by the detents 38 on its tail piece engaged against the shoulders or retaining flanges 24 and 25 in the retainer housing 17. Downward movement of the actuator 47 forces the stem and thus the flexible valve seat member 26 downwardly against the pressure of the contents of the container and the preset bias of the diaphragm 29. Engagement of the valve engaging member or projection 49 with the head 36 of the poppet valve 35 also forces the poppet downwardly. However, the initial downward movement of the valve seat member results in unseating the poppet from the valve seat 33, enabling flow from the device. Continued downward movement of the actuator results in contact between the lower end 31 of the valve seat member 30 against the shoulder 50 at the bottom end of retainer housing 17, stopping further downward movement of the valve seat member 30. Release of force from the actuator 47 enables the pressure of the contents of the container and the preset bias of the diaphragm 29 to return the parts to their normal position shown in FIG. 1.

The dispensing valve thus described is exceptionally simple in construction and operation, and may be made entirely from plastic materials. For instance, the poppet may be made from high density P/E, and the cylinder housing and retainer 11 and flexible valve housing and seat member 24 may be made from PET. Additionally, the container C may be made from a suitable plastic material, such as PET, whereby the sonic weld described above can be accomplished. The resultant structure eliminates or minimizes the critical tolerances which must be maintained with prior art devices, and does not require separate springs, sealing gaskets or tight sliding fits between valving components as are essential in prior art devices.

Figure 9:
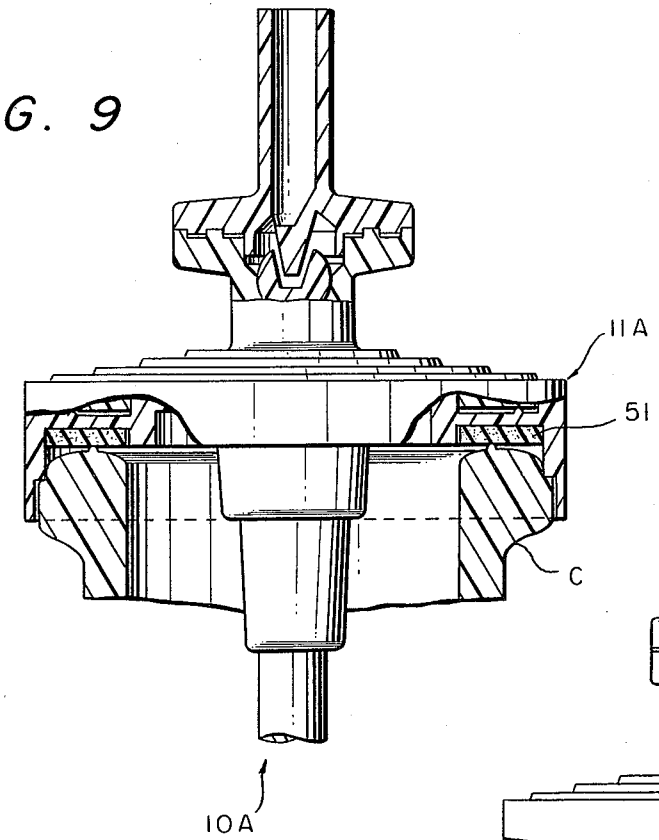
FIG. 9 is a fragmentary view, with parts shown in section and parts in elevation, of a first variation of the attaching means for the valve of FIG. 1.

A first variation of the invention is shown at 10A in FIG. 9, wherein a separate tri-seal or flex seal gasket 51 is interposed between the main cylinder housing and poppet retainer 11A and the top of the container C. In all other respects, this form of the invention is identical to that previously described.

Figure 10:
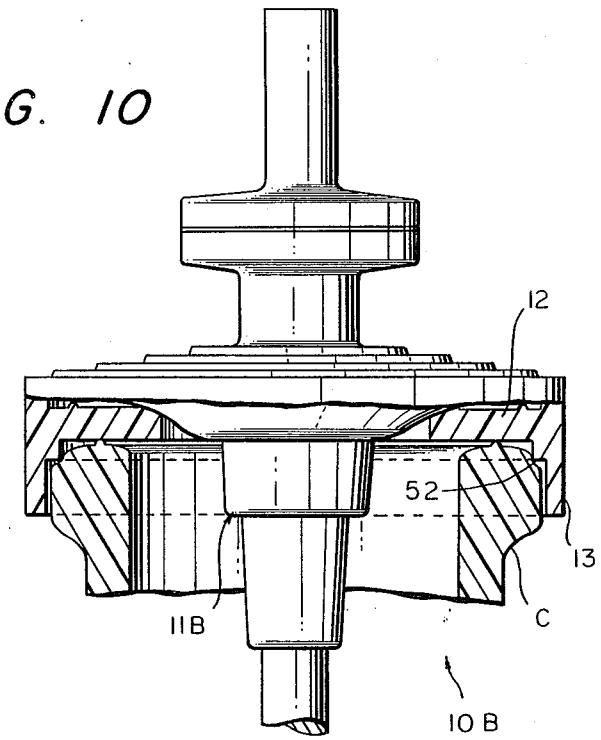
FIG. 10 is a view similar to FIG. 9 of a second variation of the attaching means for the valve of FIG. 1.

A second variation of the invention is shown at 10B in FIG. 10, wherein the main cylinder housing and poppet retainer 11B has an annular shoulder 52 at the juncture of the skirt 13 and wall portion 12 for effecting an energy scarf joint for sonic welding with the outer end surface of the neck mating surface of the container C. This is the only difference between this form of the invention and that illustrated in FIGS. 1 through 8.

Figure 11:
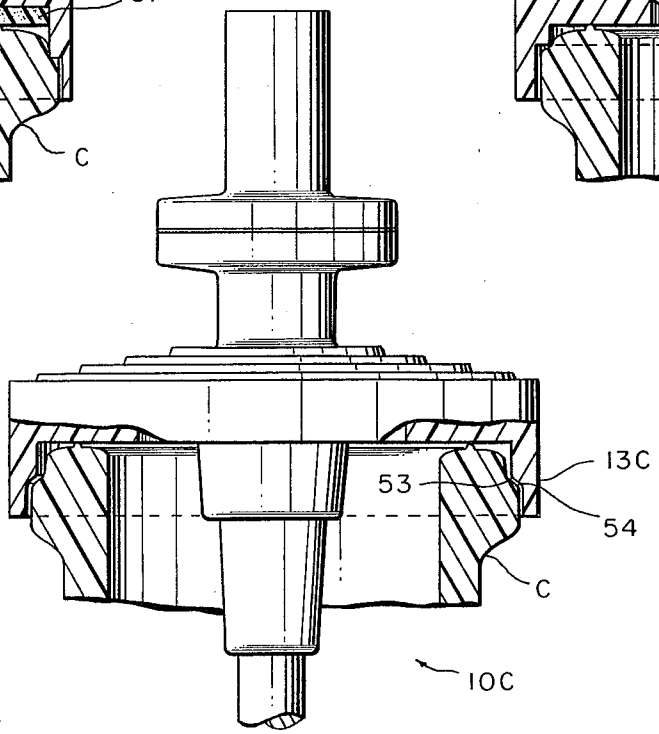
FIG. 11 is a view similar to FIGS. 9 and 10 of a third variation of the attaching means for the valve of FIG. 1.

A third variation of the invention is shown at 10C in FIG. 11, wherein the inner surface of the skirt 13C is provided with an annular, outwardly and downwardly sloping shoulder 53 for cooperative engagement with an annular shoulder 54 formed on the outer surface of the neck of the container C, defining a scarf joint for sonic welding. Just as with the other variations, this form is also identical in all other respects to the form first described.

A second form of the invention is shown at 60 in FIGS. 12 through 17. In this form of the invention, the poppet 61 and valve seat member 62 are modified to provide a double valving action, and the stem attaching flange 63 and stem 64 are modified for snap assembly of the stem to the stem attaching flange for interchangeability of stems. Further, the main cylinder housing and poppet retainer 65 and the flexible valve housing and seat member 62 are modified for snap engagement with one another. The flexible valve housing and seat member 62 has an outer, depending cylindrical skirt 66 with an annular, downwardly facing shoulder 67 formed on the inner surface thereof for engagement with an outer surface 68 on the neck of the container C, forming a scarf joint for sonic welding of the member 62 to the container to thus secure the snapped-together valve components to the container. An annular inwardly projecting locking ring or bead 69 on the inner surface of the skirt 66 cooperates with an outwardly projecting flange 70 on the outer margin of the retainer 65, defining the means to snap the retainer 65 and seat member 62 together. The seat member 62 also includes a downwardly extending cylindrical wall 71 which engages behind the flange 70 on the retainer 65, defining a pocket 72 in which the flange 70 is received, to strengthen the snap-fitting of these pieces.

The double valving action between the poppet 61 and valve seat member 62 is provided by the downwardly and inwardly sloping seat 33 and head 36 of the poppet, as in the previously described form of the invention, and by a second sealing area 73 defined by a skirt 74 depending from the seat 33 and having an inwardly directed sealing flange 75 thereon for cooperation with a valve land 76 formed beneath the head of the poppet 61. A slotted area 77 extends along the tail piece of the poppet below the valve land 76 to provide flow paths for product past the second sealing area 73 when the valve is in an opened position (see the dot-and-dash lines on the right hand side of FIG. 12).

Snap engagement of the stem 64 on the stem attaching flange 63 is accomplished by means of a plurality of spaced apart detents or locking flanges 78 formed on the inner surface of a depending skirt 79 at the outer marginal edge of the flange 80 of the stem, and an outwardly extending locking flange 81 on the stem attaching flange 63. As seen in FIGS. 12 through 15, the locking flanges 78 on the stem have sloping bottom surfaces 82 and a substantially horizontal shoulder 83, whereby the stem may be pushed down onto the attaching flange to lock the parts together.

With the exception of the double valving arrangement, the snap together features, and the sonic welding of the flexible valve housing to the container, this form of the invention is essentially the same as that described previously, and like reference characters are applied to corresponding parts.

Figure 18:
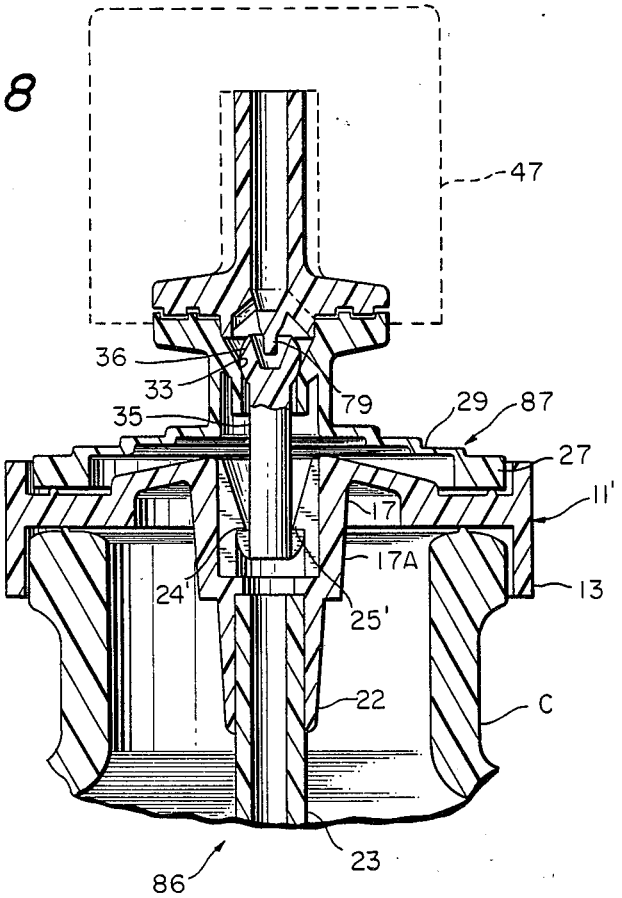
FIG. 18 is a vertical sectional view similar to FIG. 1 of a modification of the invention in which the underside of the diaphragm is exposed to pressure in the container.

A third form of the invention is shown at 86 in FIG. 18, and in this form of the invention, the valve seat member 87 does not have a depending cylindrical portion such as 31 in the first form described. Instead, the entire area of the diaphragm 29 is exposed to the pressure of the contents of the container. Thus, considerably more closing force is acting upon the diaphragm to urge the seat 33 into sealing engagement with the head 36 of the poppet 35. The poppet retainer 11′ is also slightly modified to have longer sloping surfaces leading downwardly from the upper end to the poppet retainers 24′ and 25′ than in the first form described. In all other respects, this form of the invention is identical to the forms first described.

Figure 19:
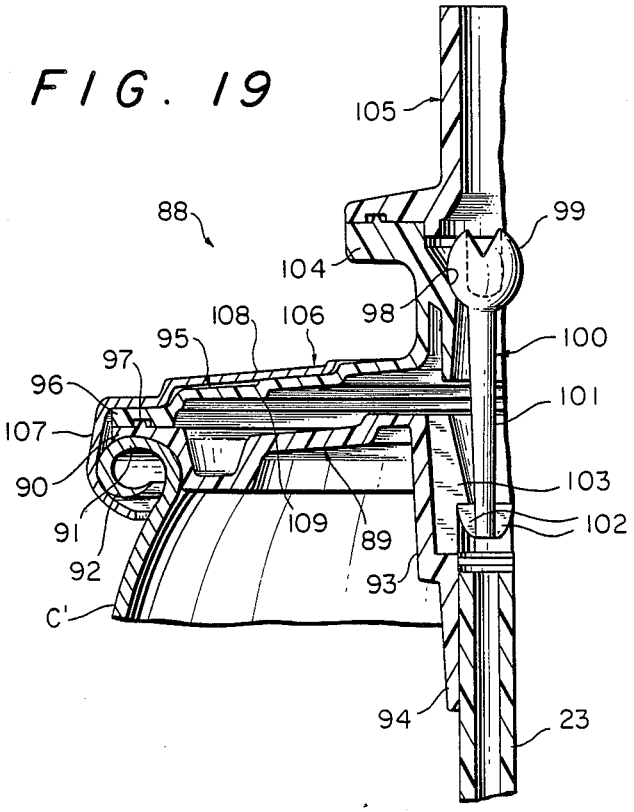
FIG. 19 is a vertical sectional view of a further form of the invention, in which a metal ferrule is used to secure the valve assembly to a metal can.

A fourth form of the invention is indicated generally at 88 in FIG. 19, and comprises a main body and poppet retainer 89 having an annular outer marginal mounting flange 90 with a shaped undersurface 91 adapted to fit the shape of the rolled lip 92 on a metal container C′. A depending cylindrical retainer housing 93 and dip tube extension 94 are formed at the center of the retainer 89 as in the previously described forms of the invention. A flexible valve housing and seat member 95 is sonically welded to the mounting flange of the retainer 89 via an annular flange 96 and energy bead 97, and includes a depending cylindrical seat 98 for cooperation with the head 99 of a poppet 100. The poppet includes a tail piece 101 with detents 102 on the lower end thereof for cooperation with complemental detents 103 in the retainer housing 93. The valve housing and seat member 95 also includes a stem mounting flange 104, and a stem 105 is sonically welded to this flange just as in the previously described forms of the invention. The assembly thus described is held affixed to the container C′ by a shaped metal ferrule 106 having a flange 107 extended downwardly over the outer edges of the main body 89 and seat member 95 and under the rolled lip on the container. The ferrule 106 also has an inwardly extending wall 108 disposed in overlying relationship to the flexible diaphragm 109 of seat member 95. The functions of the various components of this form of the invention, and their operation, are identical to that described in relation to FIG. 18.

Figure 12:
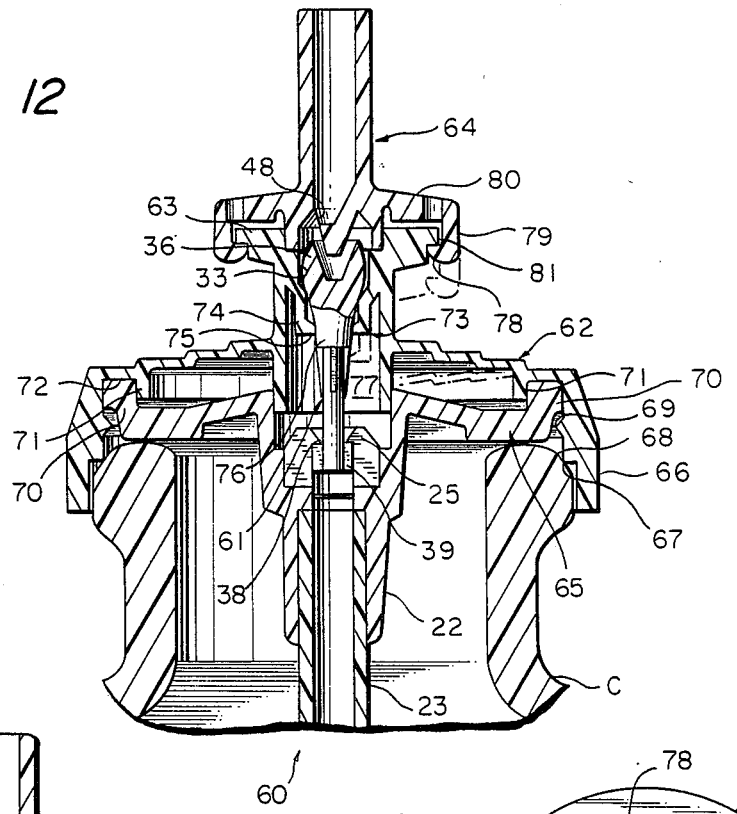
FIG. 12 is a view similar to FIG. 1 of a modification of the valve of FIG. 1, in which the valve components are adapted to be snapped together and then sonically welded to a container, and in which a double sealing action is effected between the poppet and flexible valve housing and seat member.
Figure 13:
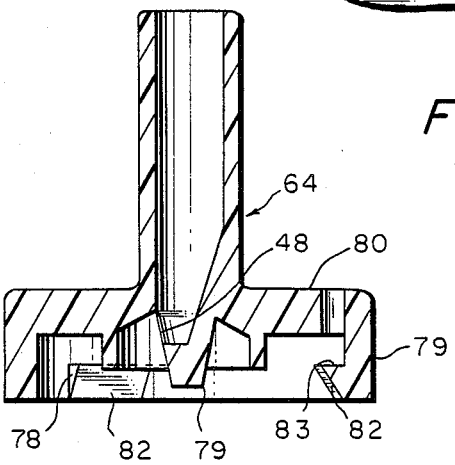
FIG. 13 is an enlarged vertical sectional view of the interchangeable valve stem of the valve shown in FIG. 12.
Figure 14:
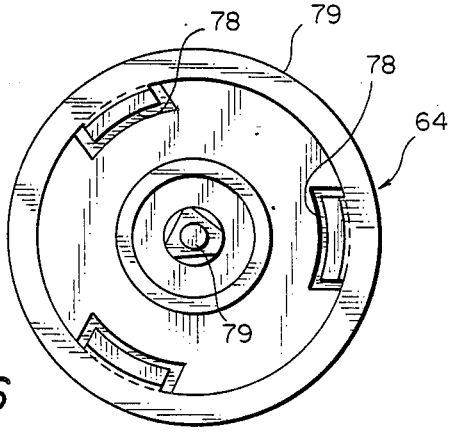
FIG. 14 is a bottom plan view of the stem of FIG. 13.
Figure 15:
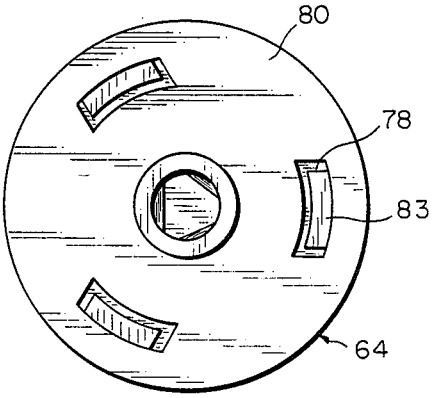
FIG. 15 is a top plan view of the stem of FIG. 13.
Figure 16:
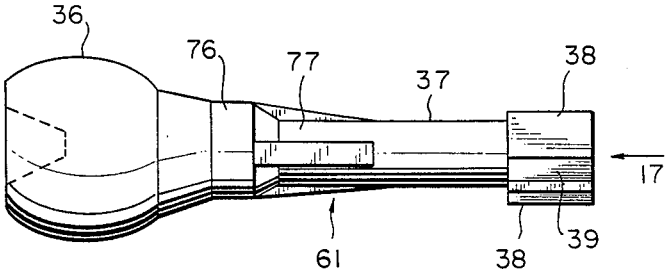
FIG. 16 is an enlarged view in elevation of the poppet used in the valve of FIG. 12.
Figure 17:
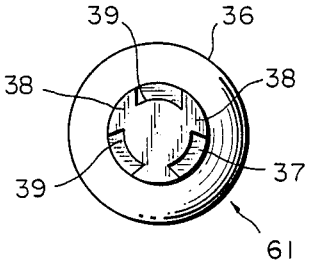
FIG. 17 is an end view taken in the direction of the arrow 17 in FIG. 16.
Figure 20:
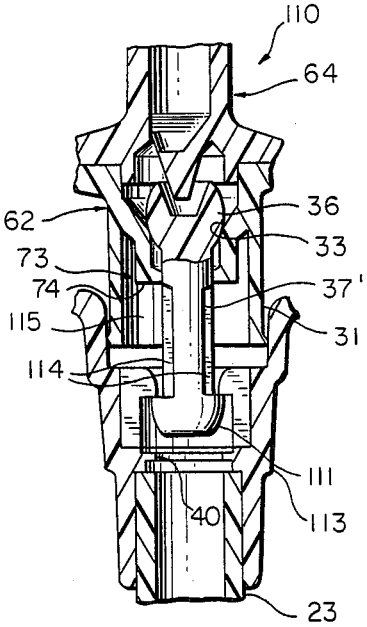
FIG. 20 is a fragmentary vertical sectional view of a modification of the valve of FIG. 12, in which the tail piece of the poppet is modified to achieve metered flow, with the valve shown in the normal, upper closed position.
Figure 21:
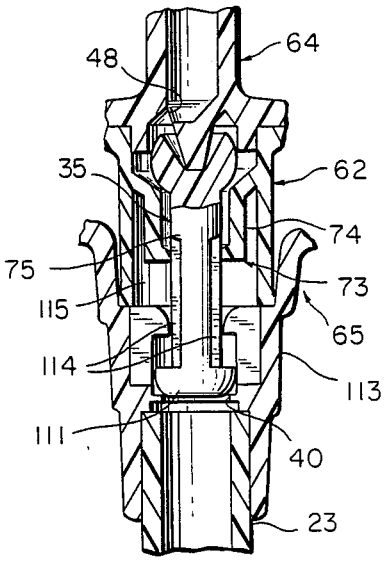
FIG. 21 is a view similar to FIG. 20, but with the valve in its lower seated position.

A fifth form of the invention is shown generally at 110 in FIG. 20 and is substantially identical to that shown in FIG. 12, except that the lower end of the tail piece 37′ is formed with a valve head 111 for seating against the seat 40 formed at the bottom of the retainer housing 113. The length of the tail piece is slotted at 114 between the bottom valve head 114 and the second sealing area 73 beneath the main valve head 36 to enable flow past the poppet when the valve is opened. In this form of the invention, the area or space 115 defined by the depending sleeve 31 and the retainer housing 113 between the seating area 73 at the upper end of the poppet and the ring seal or seat 40 at the lower end of the poppet provides a metered dispensing of product. Thus, with the parts in the position shown in FIG. 20, the space 115 is full of product under pressure. When the actuator is depressed to move the flexible valve housing and seat member 62 downwardly, the sealing flange 74 moves off the valve land 75 and flow begins from the container and through the slots 114. Continued downward movement of the actuator brings the lower head 111 into engaement with its seat 40, shutting off flow from the container. See FIG. 21. Thus, only a metered amount (as determined by dimensions, valve travel, etc.) of product is dispensed upon actuation of the valve in this form of the invention.

Figure 22:
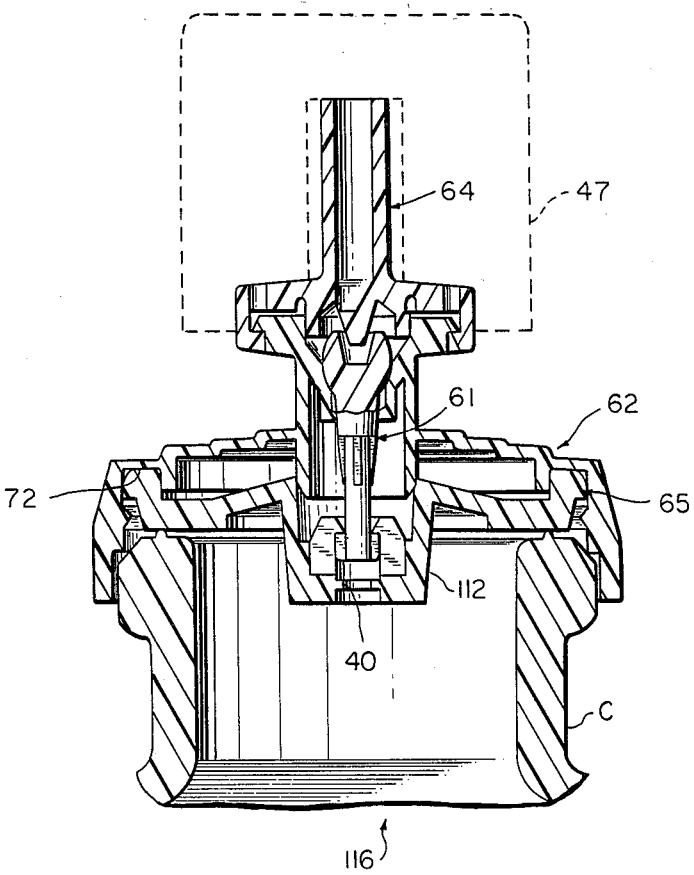
FIG. 22 is a fragmentary sectional view similar to FIG. 12 of a form of the valve in which the dip tube is eliminated.

A further variation of this form of the invention is shown at 116 in FIG. 22, wherein the dip tube extension and dip tube are omitted. The structure and function of this form of the invention are otherwise essentially the same as that described in relation to FIGS. 20 and 21.

While the invention has been shown and described in detail herein, it is to be understood that various changes in construction may be made without departing from the scope of the invention as defined by the claims appended hereto.

I claim:

1. An aerosol valve, comprising:

a main body and poppet retainer having a central portion with means defining a poppet retainer;

a flexible valve housing and seat member having an outer marginal portion and a central portion and means securing it to said main body, means at the central portion defining a valve seat, flexible means connecting the central portion to the outer marginal portion for movement of the central portion and valve seat relative to the outer marginal portion and main body;

a poppet valve having a valve head at one end and a tail piece extending away from the head, said valve head disposed in cooperative relationship with said valve seat for opening and closing movement between said valve head and valve seat, detent means on said tail piece cooperating with the poppet retainer means on the main body to define spaced detents for limiting movement of the poppet valve in both directions along the axis of the tail piece so that limited relative movement between the valve head and valve seat and between the poppet valve and main body is possible;

means urging said seat member to move in a direction relative to said poppet valve to seat said valve head on said valve seat;

actuator means connected with said flexible valve housing and seat member to move the seat member relative to the poppet valve to move the valve head and valve seat apart to open the valve and enable flow from the container; and means for securing the valve to an open end of a container.

2. An aerosol valve as claimed in claim 1, wherein:

said means urging the seat member in a direction to seat the valve head on the valve seat comprises said flexible means connecting said central portion with the marginal portion, said flexible means comprising a diaphragm.

3. An aerosol valve as claimed in claim 2, wherein:

said diaphragm has a preset bias tending to seat the valve head and valve seat against one another.

4. An aerosol valve as claimed in claim 2, wherein:

said main body and poppet retainer, said flexible valve housing and seat member and said poppet valve are all made from synthetic plastic materials.

5. An aerosol valve as claimed in claim 4, wherein:

said main body is positioned between the flexible valve housing and the container, said main body and said flexible valve housing defining a valve chamber between them; and said poppet valve is freely reciprocable in said valve chamber.

6. An aerosol valve as claimed in claim 5, wherein:

the valve seat on said flexible valve housing faces outwardly away from the container, and said poppet valve tail piece extends through the area bounded by the valve seat and into proximity with the poppet retainer on the main body.

7. An aerosol valve as claimed in claim 1, wherein:

a cylindrical skirt depends from the flexible valve housing at the central portion thereof surrounding the area of the valve seat, said skirt being slidably received in a cylindrical retainer housing in the main body, and defining with the main body a limited space exposed to the pressure of the contents of the container.

8. An aerosol valve as claimed in claim 6, wherein:

the entire area of the diaphragm is exposed to the pressure of the contents of the container.

9. An aerosol valve as claimed in claim 4, wherein:

the main body is secured and sealed to the container, and the flexible valve housing is secured and sealed to the main body by ultrasonic welds.

10. An aerosol valve as claimed in claim 1, wherein:

the actuator means includes a stem, said stem, flexible valve housing and main body are snapped together, and the flexible valve housing is secured and sealed to the container by a sonic weld, thereby securing the valve to the container.

11. An aerosol valve as claimed in claim 9, wherein:

a stem is secured to the flexible valve housing and seat member, said stem being adapted to receive and support said actuator means.

12. An aerosol valve as claimed in claim 1, wherein:

said poppet valve includes a secondary valve sealing area beneath said valve head, and said flexible valve housing includes a second valve seat in a position to cooperate with the secondary valve sealing area on the poppet valve, thereby providing plural valve sealing areas on the poppet valve.

13. An aerosol valve as claimed in claim 12, wherein:

the secondary sealing area comprises a valve land on the poppet valve tail piece, and the second valve seat comprises an annular, flexible sealing lip on the flexible valve housing, said lip engaged in sliding contact with the valve land to preclude flow from the container past the poppet valve when the valve is in a closed position and being slidable into a position out of engagement with the valve land when the valve is in an open position.

14. An aerosol valve as claimed in claim 1, wherein:

a stem is secured to the flexible valve housing and seat member, said stem adapted to receive and support said actuator.

15. An aerosol valve as claimed in claim 14, wherein:

the flexible valve housing is snap-fitted to the main body.

16. An aerosol valve as claimed in claim 15, wherein:

the stem is snap-fitted to the flexible valve housing for interchangeability of the stem.

17. An aerosol valve as claimed in claim 11, wherein:

the stem is secured to the flexible valve housing by ultrasonic welding.

18. An aerosol valve as claimed in claim 7, wherein:

said poppet valve has a second valve head on the end of the tail piece opposite said first-named valve head, and said main body has a valve seat adjacent said poppet retainer, said second valve head adapted to seat against said valve seat on the main body after predetermined travel of the poppet valve upon manipulating the actuator to unseat the first valve head from the valve seat on the flexible valve housing, thereby precluding further flow from the container and obtaining a metered dispensing of product from the container upon actuation of the valve.

19. An aerosol valve as claimed in claim 6, wherein:

the main body is secured and sealed to the container by a metal ferrule.

20. An aerosol valve as claimed in claim 19, wherein:

the flexible valve housing is secured and sealed to the main body by an ultrasonic weld.

21. An aerosol valve as claimed in claim 1, wherein:

said poppet valve has a second valve head on the end of the tail piece opposite said first-named valve head, and said main body has a valve seat adjacent said poppet retainer, said second valve head adapted to seat against said valve seat on the main body after predetermined travel of the poppet valve upon manipulating the actuator to unseat the first valve head from the valve seat on the flexible valve housing, thereby precluding further flow from the container and obtaining a metered dispensing of product from the container upon actuation of the valve.

22. An aerosol valve as claimed in claim 21, wherein:

said main body central portion has a cylindrically shaped passage therethrough, and said valve seat on the main body comprises an annular seat ring formed in the cylindrical passage in a position to be engaged by said second valve head after said predetermined travel of the poppet valve.

23. An aerosol valve as claimed in claim 1, including, in combination:

a container having an open neck; and means on said container neck and said aerosol valve effecting an ultrasonic weld between the container and the aerosol valve to secure and seal the aerosol valve to the container.

24. The combination as claimed in claim 23, wherein: said container neck and at least a portion of said aerosol valve are made from compatible synthetic plastic material whereby said ultrasonic weld may be effected.

25. An aerosol valve as claimed in claim 1, wherein: said spaced detents comprise a pair of spaced apart limit stops formed on the poppet retainer, and a radially enlarged detent on the tail piece for reciprocating movement between the spaced apart limit stops on the poppet retainer.

26. An aerosol valve, comprising:

a main body and poppet retainer having a central portion with means defining a poppet retainer;

a flexible valve housing and seat member having an outer marginal portion and a central portion and means securing it to said main body, means at the central portion defining a valve seat, flexible means connecting the central portion to the outer marginal portion for movement of the central portion and valve seat relative to the outer marginal portion and main body;

a poppet valve having a valve head at one end and a tail piece extending away from the head, said valve head disposed in cooperative relationship with said valve seat for opening and closing movement between said valve head and valve seat, a valve land on the poppet valve tail piece beneath the valve head defining a secondary valve sealing area, said flexible valve housing including a second valve seat in a position to cooperate with the valve land to provide plural valve sealing areas on the poppet valve, said second valve seat comprising an annular, flexible sealing lip on the flexible valve housing, said lip engaged in sliding contact with the valve land to preclude flow from the container past the poppet valve when the valve is in a closed position and being slidable into a position out of engagement with the valve land when the valve is in an open position, detent means on said tail piece arranged to cooperate with the poppet retainer means on the main body to limit movement of the poppet valve so that relative movement between the valve head and valve seat is possible;

means urging said seat member to move in a direction relative to said poppet valve to seat said valve head on said valve seat;

actuator means connected with said flexible valve housing and seat member to move the seat member relative to the poppet valve to move the valve head and valve seat apart to open the valve and enable flow from the container; and means for securing the valve to an open end of a container.

27. An aerosol valve, comprising:

a main body and poppet retainer having a central portion with means defining a poppet retainer;

a flexible valve housing and seat member having an outer marginal portion and a central portion and means securing it to said main body, means at the central portion defining a valve seat, flexible means connecting the central portion to the outer marginal portion for movement of the central portion and valve seat relative to the outer marginal portion and main body;

a poppet valve having a valve head at one end and a tail piece extending away from the head, said valve head disposed in cooperative relationship with said valve seat for opening and closing movement between said valve head and valve seat, detent means on said tail piece arranged to cooperate with the poppet retainer means on the main body to limit movement of the poppet valve so that relative movement between the valve head and valve seat is possible;

means urging said seat member to move in a direction relative to said poppet valve to seat said valve head on said valve seat;

actuator means connected with said flexible valve housing and seat member to move the seat member relative to the poppet valve to move the valve head and valve seat apart to open the valve and enable flow from the container;

a stem secured to the flexible valve housing and seat member to receive and support the actuator means, said stem being snap-fitted to the flexible valve housing for interchangeability of the stem; and means for securing the valve to an open end of a container.

28. An aerosol valve as claimed in claim 27, wherein:

a pair of spaced apart limit stops are formed on the poppet retainer, and a radially enlarged detent is on the tail piece for reciprocating movement between the spaced apart limit stops on the poppet retainer to limit reciprocating movement of the poppet valve in two directions.

* * * * *